US007105740B2

(12) United States Patent
Allaire et al.

(10) Patent No.: US 7,105,740 B2
(45) Date of Patent: Sep. 12, 2006

(54) STRANDED COPPER-PLATED ALUMINUM CABLE, AND METHOD FOR ITS FABRICATION

(75) Inventors: Isabelle Michel épouse Allaire, Chassieu (FR); Louis Salvat, Tignieu Jameyzieu (FR)

(73) Assignee: F.S.P.—One, Pont de Cheruy (FR)

( * ) Notice: Subject to any disclaimer, the term of this patent is extended or adjusted under 35 U.S.C. 154(b) by 0 days.

(21) Appl. No.: 11/247,834

(22) Filed: Oct. 11, 2005

(65) Prior Publication Data

US 2006/0102368 A1 May 18, 2006

(30) Foreign Application Priority Data

Oct. 12, 2004 (FR) ..... 04 11024

(51) Int. Cl.
*H01B 7/34* (2006.01)

(52) U.S. Cl. ..... 174/36

(58) Field of Classification Search ..... 174/36, 174/102 R, 106 R, 107, 108, 126.1, 128.1, 174/128.2; 29/825; 205/176, 181
See application file for complete search history.

(56) References Cited

U.S. PATENT DOCUMENTS 3,306,088 A * 2/1967 Adler ..... 72/47
3,647,939 A * 3/1972 Schoemer ..... 174/128.1
3,692,924 A * 9/1972 Nye ..... 174/120 SR
3,810,287 A * 5/1974 Pryor et al. ..... 428/607
3,890,701 A * 6/1975 Diepers ..... 29/599
3,915,667 A * 10/1975 Ricks ..... 428/648
3,926,573 A * 12/1975 Sexton ..... 428/652
5,679,232 A * 10/1997 Fedor et al. ..... 205/77
6,123,788 A * 9/2000 Clouser et al. ..... 148/684
6,178,623 B1 * 1/2001 Kitazawa et al. ..... 29/825
6,780,303 B1 * 8/2004 Colombier et al. ..... 205/139
2001/0031372 A1 * 10/2001 Ostolski ..... 428/570
2005/0178669 A1 * 8/2005 Strubbe ..... 205/185

FOREIGN PATENT DOCUMENTS

DE 19633615 A1 2/1998
FR 2083323 A 12/1971

OTHER PUBLICATIONS

Engineering Design Guide, 3rd Edition, C & M Corporation, Jan. 1992, pp. 2-5 and 10-14.*

* cited by examiner

*Primary Examiner*—William H. Mayo, III
(74) *Attorney, Agent, or Firm*—William H. Eilberg

(57) ABSTRACT

Aluminum cable type electrical conductor having at least one stranded conductor based on conductive wires with an aluminum core coated with an intermediate layer of copper itself coated by a surface layer of nickel. The surface layer of nickel has a thickness from about 1.3 μm to about 3 μm, it has sufficient continuity to resist a polysulfide bath continuity test for at least 30 seconds without visible traces of attack of the copper appearing at ×1O magnification. This kind of conductor is particularly suitable in small diameters for conducting electricity in aircraft and motor vehicles.

22 Claims, 4 Drawing Sheets

STRANDED COPPER-PLATED ALUMINUM CABLE, AND METHOD FOR ITS FABRICATION

TECHNICAL FIELD OF THE INVENTION

The present invention relates to copper-plated and nickel-plated aluminum or aluminum alloy conductors. It relates more particularly to electrical cables comprising at least one conductor with an aluminum or aluminum alloy core coated with a layer of copper itself coated with a layer of nickel.

In the following description and the claims, the term "aluminum" refers in the broad sense to aluminum and its alloys. The term "conductor" refers to an electrically conductive body of elongate shape, the length whereof is large relative to its cross section, and which is generally in the form of a wire.

Electrical conductors based on aluminum are widely used to transport electrical energy. Electrical wires and cables with an aluminum core may comprise an insulative material coating, and wires or individual strands may be assembled together to form the conductive core of a cable.

Aluminum conductors used to transport and distribute electrical energy may be in an untreated state, i.e. with no particular treatment of the conductor surface. Nevertheless, it is known in the art to coat the aluminum conductor with a layer of nickel to improve its electrical contact properties.

Electrical cables consisting of stranded aluminum wires coated with nickel have already been used in aeronautical applications, for example. More than 100 kilometers of such cables are used in certain current airliners.

Aluminum has the advantage of reduced weight compared to the standard solution of copper-cored cables: for the same electrical resistance, the weight of an aluminum conductor is about half that of a copper conductor.

Despite the weight saving, applications of aluminum conductors in the aeronautical industry have remained minor, in particular because of their lower conductivity, lower yield point, worse performance in terms of flexibility, the presence of non-conductive oxides on the surface of the conductor, and problems with industrialization.

The document DE 196 33 615 A1 describes the use of an aluminum wire having a copper coating over which an external layer of nickel is applied.

The document FR 2 083 323 describes an aircraft cable comprising aluminum wires coated with copper in turn coated with a layer of nickel. Each conductor is insulated by one or more plastics material layers.

The above documents do not specify the thickness or the resistance of the nickel layer or the benefit of or the means of simultaneously achieving sufficient conductivity, a sufficiently high yield point and sufficient flexibility for use under difficult conditions in an aggressive atmosphere.

The document U.S. Pat. No. 3,915,667 A teaches coating an aluminum conductor with an internal coating of tin or zinc, then a copper-based layer, then a nickel coating, and finally an external layer of tin or silver. The intermediate nickel layer has a thickness from about 2.5 μm to about 12.7 μm. Neither the benefit of a strong surface layer of nickel nor the means of obtaining it are described.

In the field of small-diameter cables, there is a requirement to improve the compromise between the conductivity of the cable, its yield point, and its flexibility, with a view to withstanding the conditions of use of cables that must be passed through non-linear and relatively long conduits without risk of damage or jamming. Furthermore, there is a requirement for long-term protection of such cables against the appearance of non-conductive oxides of the surface under severe conditions of use, for example large and repetitive temperature changes, aggressive atmospheres. There is also a requirement to make a good electrical connection to the conductors without damaging their structure by mechanical clamping.

SUMMARY OF THE INVENTION

An object of the invention is to propose a new stranded cable structure for conducting electrical current having simultaneously low electrical resistivity, good flexibility, a sufficiently high yield point, good electrical contact properties, good anti-corrosion properties for long term use under aggressive conditions, and good capacities for withstanding mechanical clamping for making electrical connections.

One particular problem to be solved is that of providing a protective surface layer of nickel that is of satisfactory quality, both in terms of providing a seal and in terms of adhesion to the underlying layer of the conductor, but which does not significantly interfere with the other properties of the conductor, such as electrical conductivity, flexibility, weight, yield point.

To this end, the invention proposes an aluminum cable type electrical conductor comprising at least one stranded conductor based on conductive wires with an aluminum core coated with an intermediate layer of copper itself coated by a surface layer of nickel. The invention provides such a surface layer of nickel with a thickness from about 1.3 μm to about 3.0 μm, this surface layer of nickel having sufficient continuity to resist a polysulfide bath continuity test for at least 30 seconds without visible traces of attack of the copper appearing at ×10 magnification.

The polysulfide bath continuity test is defined by the American Society for Testing and Materials standard ASTM B298.

Details of the polysulfide bath continuity test are given hereinafter.

The thickness of the surface layer of nickel is preferably from about 2 μm to about 3 μm.

Good results may be obtained with a thickness of the surface layer of nickel of about 2.3 μm.

The conductor may also consist of a cable comprising seven stranded conductors each of 10 or 15 wires having an individual diameter of about 0.51 mm.

For a different application, the conductor may consist of a cable with seven stranded conductors each of 19 wires having an individual diameter of about 0.275 mm.

For a different application, the conductor may consist of a cable with one stranded conductor of 61 wires having an individual diameter of about 0.32 mm.

For a different application, the conductor may consist of a cable with one stranded conductor of 37 wires having a diameter of about 0.32 mm or about 0.25 mm.

For a different application, the conductor may consist of a cable comprising one stranded conductor of 19 wires having a diameter of about 0.30 mm or about 0.25 mm or about 0.20 mm.

To increase the mechanical strength of the cable of small diameters, the conductor may advantageously comprise a central wire of nickel-plated copper alloy surrounded by six wires of nickel-plated copper-plated aluminum with a diameter of about 0.25 mm or about 0.20 mm.

The cable may be stranded with one or more true concentric or unilay concentric wires or stranded conductors. The stranded conductor(s) and/or the cable may then be coated with an insulative layer of polyimide and an external layer of polytetrafluoroethylene.

One problem to be solved is that of producing a continuous, adherent and sealed nickel layer on an industrial scale and at low cost. To this end, the invention proposes a copper-plated and nickel-plated aluminum wire fabrication procedure including the following steps:

a) providing a wire blank with an aluminum core coated with a layer of copper representing 10% to 20% by volume, of diameter from twice to five times the required final diameter of the wire, b) degreasing the wire blank, c) etching the wire blank using sulfamic acid, d) depositing on the wire blank a layer of nickel by electrolysis in an electrolysis bath containing aqueous nickel sulfamate, e) rinsing the wire obtained with demineralized water, f) drawing the wire obtained in whole oil to the final diameter, g) stranding a plurality of the wires obtained in this way into bundles of wires, h) annealing in a neutral gas.

In particular the above method prevents the appearance of oxides at the interfaces between the layers, in particular under the nickel layer, which oxides would subsequently be liable, during drawing, to produce discontinuities in the surface nickel layer and thereby reduce the protective and contact properties of that layer.

In the neutral gas annealing step h), the neutral gas can advantageously be nitrogen.

In the neutral gas annealing step h), the temperature may be maintained at about 250° C. for at least about two hours.

The step d) is especially critical. In this step, the temperature of the electrolysis bath can be maintained from about 55° C. to about 65° C., the pH of the electrolysis bath can be maintained from about 2.3 to about 3.0, the current density is from 10 A/dm$^2$ to 16 A/dm$^2$, the concentration of nickel can be maintained at less than 140 grams per liter approximately in the electrolysis bath. This makes it more certain of producing a conductor that satisfies the optical examination polysulfide bath protection test referred to above.

To optimize the process, in the step d), the temperature of the electrolysis bath may be about 60° C., the pH of the electrolysis bath may be about 2.4, and the current density may be about 15 A/dm$^2$ to about 16 A/dm$^2$.

The method preferably comprises a prior step $a_o$) of calibrating the copper-plated aluminum wire blank in terms of dimensions and hardness.

After a calibration step $a_o$) of the above kind, the copper-plated aluminum wire blank may have, for example, a yield point less than or equal to about 20 daN/mm$^2$ and an elongation from about 2% to about 3%. This prevents the appearance of lacunae or discontinuities in the surface nickel layer during drawing.

In the step c), the sulfamic acid bath may advantageously have a concentration of about 40 grams per liter.

The initial diameter of the wire blank of copper-plated aluminum may be from about 1.2 mm to about 0.8 mm. The nickel may be deposited to a thickness from about 10 μm to about 15 μm. And the final diameter of the copper-plated and nickel-plated aluminum wire may be from about 0.51 mm to about 0.20 mm.

The step b) of degreasing the wire preferably comprises:

b1) degreasing the wire blank by ultrasound, b2) anodically degreasing the wire blank in a bath containing soda and surfactants, b3) rinsing the wire blank with demineralized water.

For wires of diameter less than or equal to 0.25 mm, the stranding step g) is preferably carried out before the annealing step h), whereas for wires of greater diameter the annealing step h) is preferably carried out before the stranding step g).

BRIEF DESCRIPTION OF THE DRAWINGS

Other objects, features and advantages of the present invention will emerge from the following description of particular embodiments given with reference to the appended drawings, in which.

DESCRIPTION OF THE PREFERRED EMBODIMENTS

Figure 1:
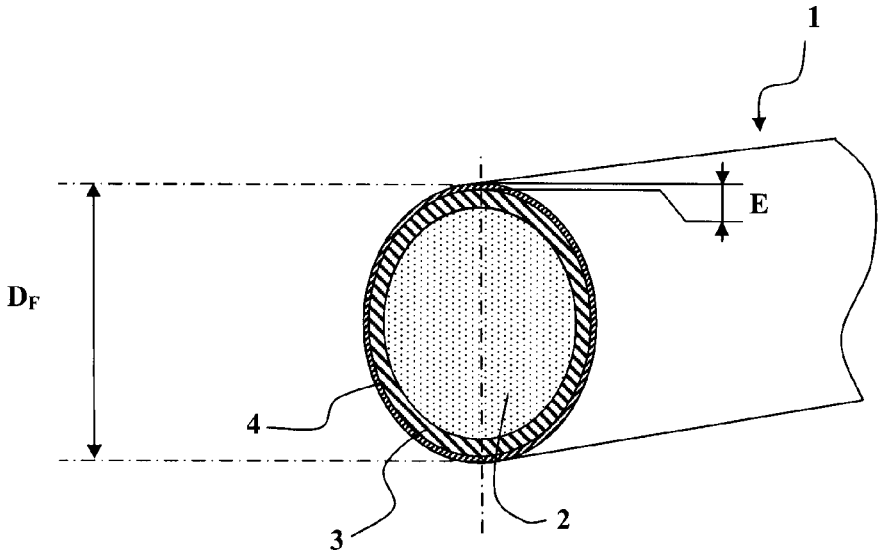
FIG. 1 is a perspective view in cross section of one embodiment of an aluminum-cored wire of the present invention.

Consider first FIG. 1, which shows the structure of one embodiment of a conductive wire 1 of the invention. There may be seen an aluminum core 2 coated with an intermediate layer 3 of copper itself coated with a surface layer 4 of nickel.

The aluminum constituting the core 2 may be pure aluminum or an aluminum alloy. An alloy of 99.5% aluminum including at most 0.10% silicon and at most 0.40% iron may be preferred.

In applications in the aeronautical industry or the automotive industry, the wire may have a final total diameter $D_F$ from about 0.51 mm to about 0.20 mm. Other diameter values could be used, however, depending on the required characteristics.

The copper of the intermediate layer 3 may advantageously represent 15% by volume of the wire. This yields a wire having the following characteristics: a density at 20° C. of approximately 3.60 kilograms per cubic decimeter, a resistivity of 2.78 $10^{-8}$ ohms per meter, a conductivity from 60% to 64% IACS, generally 62% IACS, a yield point of 138 Newtons per square millimeter, and a minimum elongation of 6%.

To achieve satisfactory flexibility combined with sufficient conductivity thanks to a large cross section, the above wires are assembled into stranded conductors by the usual cablemaking techniques.

Figure 2:
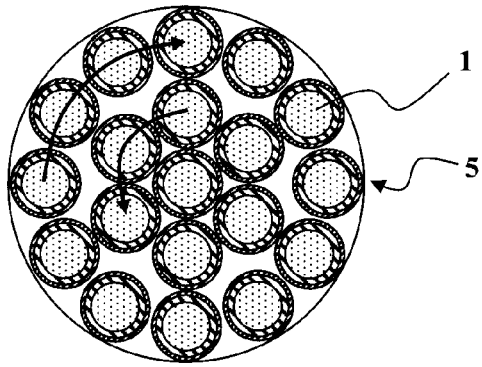
FIG. 2 is a cross section of a stranded conductor with 19 wires of the true concentric type.

For example, as shown in FIG. 2, a stranded conductor 5 made up of 19 wires like the wire 1 may be produced with a concentric stranded conductor structure with the layers in alternating directions. According to another example, shown in FIG. 3, a stranded conductor 6 made up of 19 wires like the wire 1 is produced with a unilay stranded conductor structure with the layers in the same direction.

On the other hand, a hexagonal unilay stranded conductor structure is to be avoided, because it would make electrical connection to the end of the cable more difficult or defective.

Figure 4:
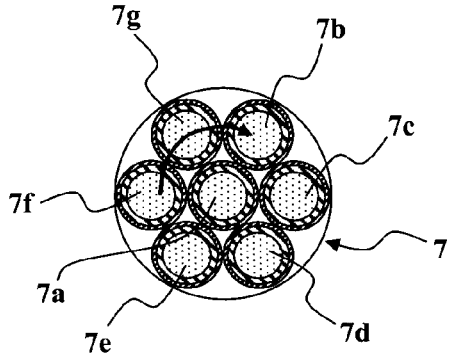
FIG. 4 is a view in cross section of a stranded conductor with seven wires.

Structures of smaller section may comprise stranded conductors 7 with seven strands, comprising a central strand 7*a* and six peripheral strands 7*b*–7*g*, as shown in FIG. 4. The central strand 7*a* may be of nickel-plated copper alloy while the peripheral strands 7*b*–7*g* are of copper-plated and nickel-plated aluminum, like the wire 1 from FIG. 1. There are obtained in this way mixed stranded conductors 7 in which this structure increases the yield point and simultaneously reduces the conductivity, to the detriment of the weight.

In the wire from FIG. 1, the thickness E of the surface layer 4 of nickel must be greater than 1.3 μm, failing which it is found that the surface layer 4 of nickel is not sufficiently continuous to provide effective protection of the intermediate copper layer 3. It is not advantageous to produce a layer of nickel thicker than about 3 μm, as this has an unfavorable effect on the other properties of the conductor, such as its electrical conductivity, flexibility, yield point, and significantly reduces the conductor fabrication rate. The thickness E of the surface layer 4 of nickel is preferably from about 2 μm to about 3 μm, and a good compromise is obtained with a surface layer 4 whereof the thickness E is approximately equal to 2.3 μm.

In practice, cables are produced having numbers of wires and stranded conductors differing according to the range.

A first example of a cable may comprise seven stranded conductors each of 10 or 15 wires having an individual diameter of about 0.51 mm.

A second example of a cable comprises seven stranded conductors each of 19 wires having an individual diameter of about 0.275 mm.

A third example of a cable comprises one stranded conductor of 61 wires having a diameter of about 0.32 mm.

Another example of a cable comprises stranded conductor of 37 wires having a diameter of about 0.32 mm or about 0.25 mm.

Figure 3:
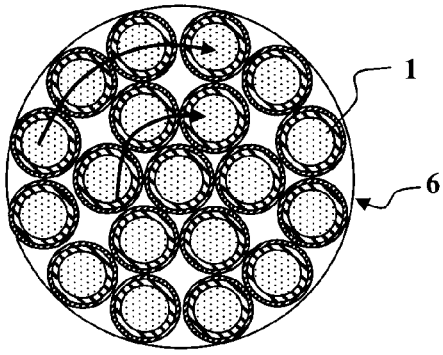
FIG. 3 is a cross section of a stranded conductor with 19 wires of the unilay concentric type.

A further example of a cable comprises one stranded conductor of 19 wires of about 0.30 mm or about 0.25 mm or about 0.20 mm with the structure shown in FIG. 2 or FIG. 3.

Finally, cables of smaller section comprise a central wire 7*a* of nickel-plated copper alloy surrounded by six wires 7*b*–7*g* of nickel-plated copper-plated aluminum with a diameter of 0.25 mm or 0.20 mm.

The stranded conductors can then be coated with an insulative layer of polyimide and an external layer of polytetrafluoroethylene.

Figure 5:
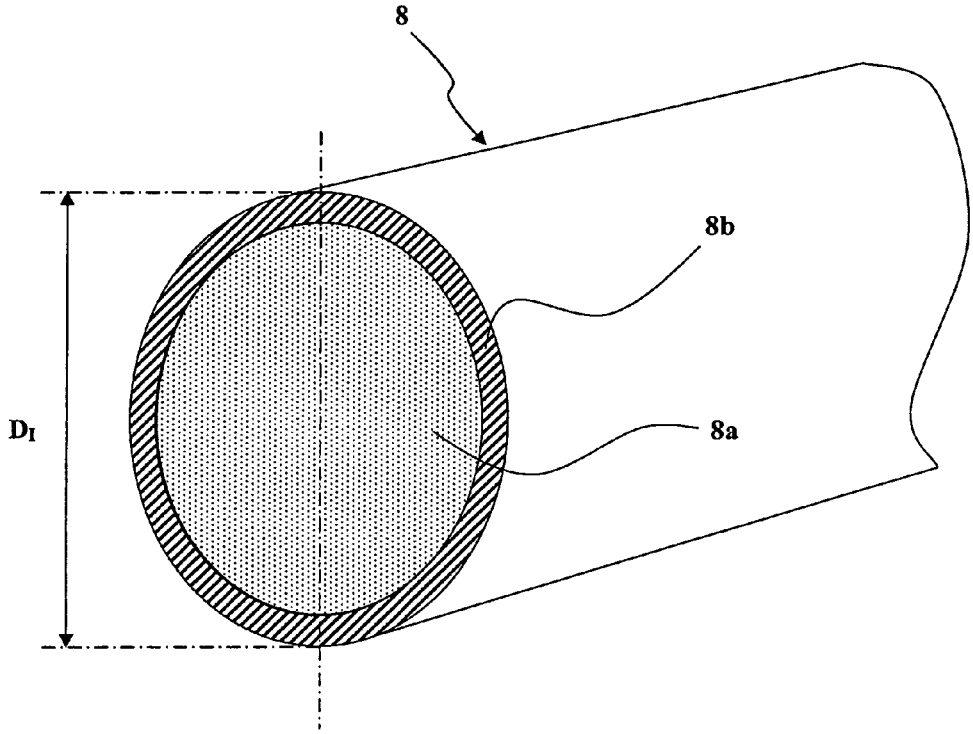
FIG. 5 is a perspective view in cross section of a copper-plated aluminum wire blank from which the wire of the invention is produced.

To produce a wire 1 as shown in FIG. 1, the starting point is a copper-plated aluminum wire blank 8 of greater diameter $D_I$, as shown in FIG. 5, the diameter $D_I$ of the wire blank 8 being from twice to five times the required final diameter $D_F$ of the wire, for example from approximately 0.8 millimeters to approximately 1.2 milli-meters. This enables fast and industrially economic processing.

Figure 6:
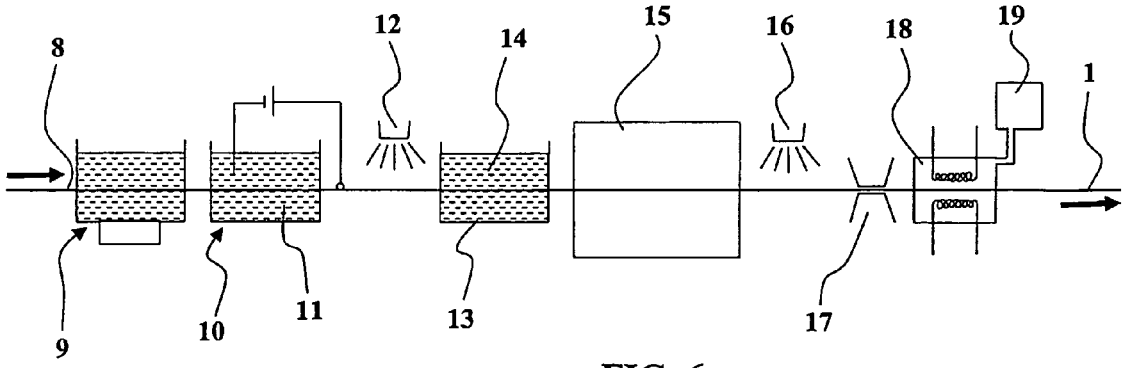
FIG. 6 is a general schematic of a device for fabricating the FIG. 1 wire in accordance with one embodiment of the invention.
Figure 7:
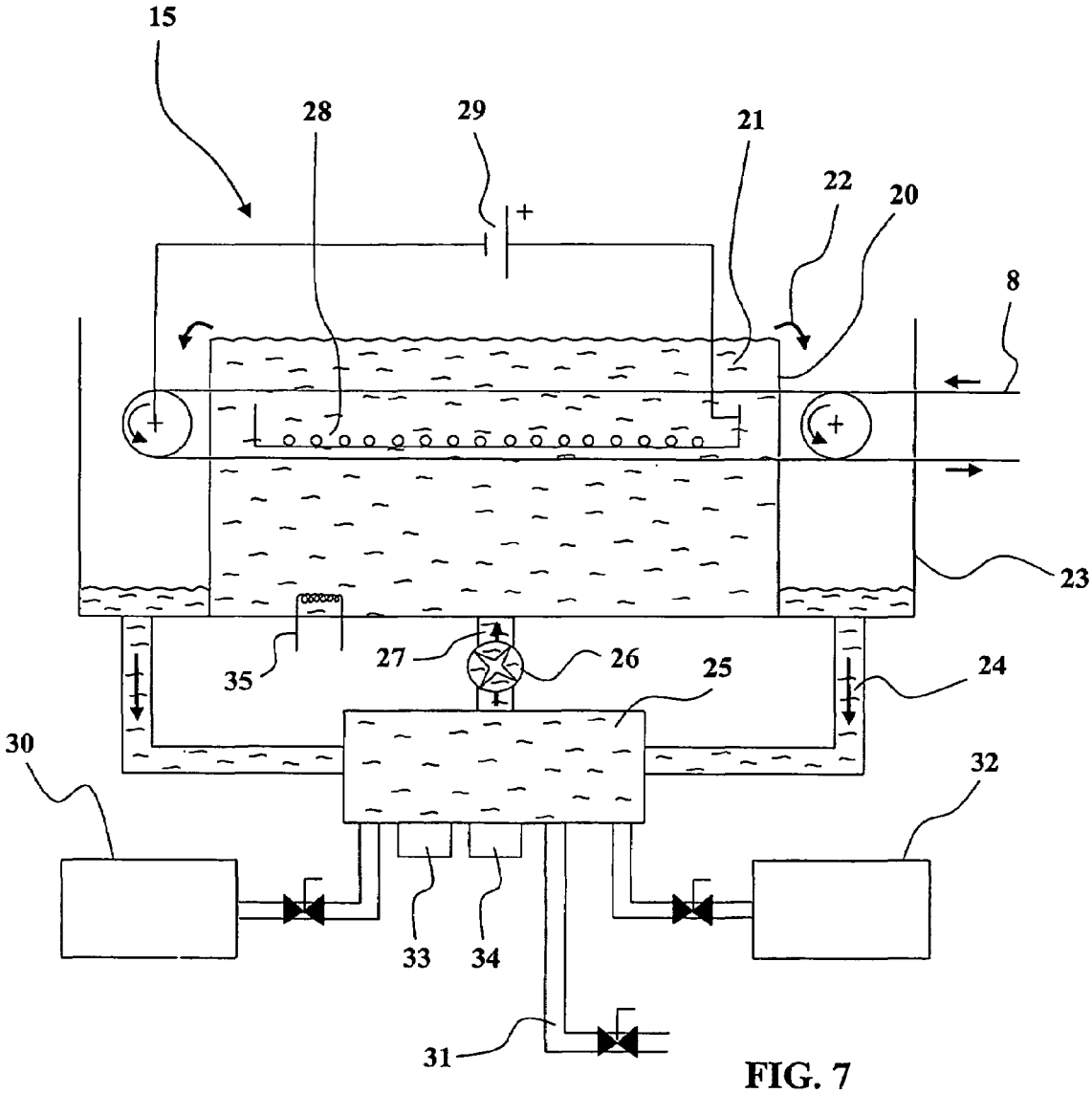
FIG. 7 is a diagram of a nickel-plating station of the FIG. 6 installation.

The wire blank 8 is processed by a process shown in FIGS. 6 and 7.

The wire blank 8 consists of an aluminum core 8*a* coated with a surface layer 8*b* of copper, the copper representing 15% by volume of the whole.

Consider now FIG. 6, which is a diagram of the general structure of a device for fabricating a wire by a method of the invention.

The wire blank 8 first enters an ultrasound device 9 that carries out a first degreasing. The wire then enters an anodic degreasing tank 10 that carries out anodic degreasing in a bath 11 that may contain soda and surfactants, for example. This ensures that the surface of the wire is free of oxides. The presence of oxides would be unfavorable to subsequent drawing.

The wire then enters a rinsing device 12 that rinses the wire with demineralized water.

The wire then enters a tank 13 containing a bath of sulfamic acid 14. The sulfamic acid concentration may advantageously be about 40 grams per liter. The surface treatment of the copper layer then facilitates subsequent adhesion of the nickel.

The wire then enters a device for electrolytically depositing nickel 15, which produces an appropriate deposit of a surface layer of nickel. The device will be described in more detail with reference to FIG. 7. The wire then enters a second rinsing device 16 which rinses the wire with demineralized water.

The wire then enters a drawing device 17 in which it is drawn in whole oil to the final diameter, i.e. in the range of diameter from about 0.51 mm to about 0.20 mm.

Drawing is generally effected at a different speed to the preceding treatments. It is therefore necessary to provide an intermediate step during which the wire is packaged on spools following the rinsing step in the rinsing device 16 and the wire is coated with a film of whole oil that protects it pending subsequent drawing.

On leaving the drawing device 17, the wire enters an oven 18 associated with a source 19 of neutral gas such as nitrogen, in which oven the wire is annealed in nitrogen at about 240° C. for about two hours. This produces the wire 1 shown in FIG. 1.

The result obtained by the above process can depend on the size and the structure of the wire blank 8. To circumvent any spread in dimensions and structure, a preliminary step of calibrating the wire blank 8 may advantageously be effected, to impart to it an appropriate and constant size and an appropriate and constant hardness. A preferred wire blank advantageously has a yield point of less than or equal to approximately 20 daN per $mm^2$ and an elongation from approximately 2% to approximately 3%, with a constant dimension chosen in the range of diameters from three times to five times the required final diameter of the wire.

The device 15 carrying out the step of depositing the layer of nickel by electrolysis is described next with reference to FIG. 7.

The device comprises an internal overflow tank 20 containing the electrolysis bath 21 which, as indicated by the arrow 22, overflows into an external tank 23 that contains the internal tank 20. The liquid collected in the external tank 23 is routed via pipes 24 to a storage tank 25 from which the liquid is returned to the internal tank 20 by a pump 26 and a pipe 27. A reserve of metallic nickel 28 is accommodated in the internal tank 20, inside the electrolysis bath 21. The wire blank 8 is moved and guided through the internal tank 20, in a plurality of passes, and exits after a layer of nickel is deposited on its surface. The reserve of nickel 28 is electrically connected to the positive pole of an electrical generator 29 whose negative pole is connected to the wire 8.

The electrolysis bath 21 contains nickel sulfamate in aqueous solution. Good results necessitate permanent monitoring of the concentration of the electrolysis bath 21. For this purpose the storage tank 25 is connected to a water supply 30, a purge pipe 31, and a source 32 of sulfamic acid. The pH of the electrolysis bath 21 is monitored by a pH sensor 33 operating on a regulator that controls corresponding valves to draw off a quantity of liquid from the electrolysis bath 21 via the purge pipe 31, to add water via the water supply 30 and to add sulfamic acid via the sulfamic acid source 32.

Tests have been carried out in which the pH of the electrolysis tank was advantageously maintained at a value from about 2.3 to about 3.0, preferably close to 2.4.

The temperature of the electrolysis bath 21 was also regulated by means of a temperature sensor 34 and heating means 35, in order for the electrolysis bath to be at a temperature of about 60° C., for example.

The nickel sulfamate concentration in the electrolysis bath 21 was maintained at a low level, for example below 140 grams per liter of nickel. Failing this, the surface layer of nickel would have been too hard, and unable to withstand well subsequent drawing.

The electrical generator 29 is adapted to regulate the electrolysis current density. In the tests that have been carried out, the electrolysis current density was advantageously maintained within a range of values from 10 A/dm$^2$ to 16 A/dm$^2$; preferably from 15 A/dm$^2$ to 16 A/dm$^2$.

By way of example, there are given hereinafter the results of a few tests that have been carried out under different electrolytic deposition conditions, and the satisfactory or unsatisfactory quality of the wire obtained is indicated, j being the current density:

| Sample | j | pH | Result |
|---|---|---|---|
| 1 | 14 | 2.5 | good |
| 2 | 14 | 2.95 | acceptable |
| 3 | 14 | 3.2 | poor |
| 4 | 14 | 3.55 | poor |
| 5 | 20 | 2.5 | poor |
| 6 | 22 | 2.5 | poor |
| 7 | 17 | 2.5 | poor |
| 8 | 11.2 | 2.5 | acceptable |
| 9 | 8.4 | 2.5 | poor |

One difficulty has been determining the quality (good, acceptable, poor) of the nickel coating produced by the process.

A polysulfide bath test as per the standard ASTM B298 has been used with success, involving a specific optical examination, which produces an overall result of checking the quality of the coating by highlighting any lacunae or microcracks in the nickel coating.

Figure 8:
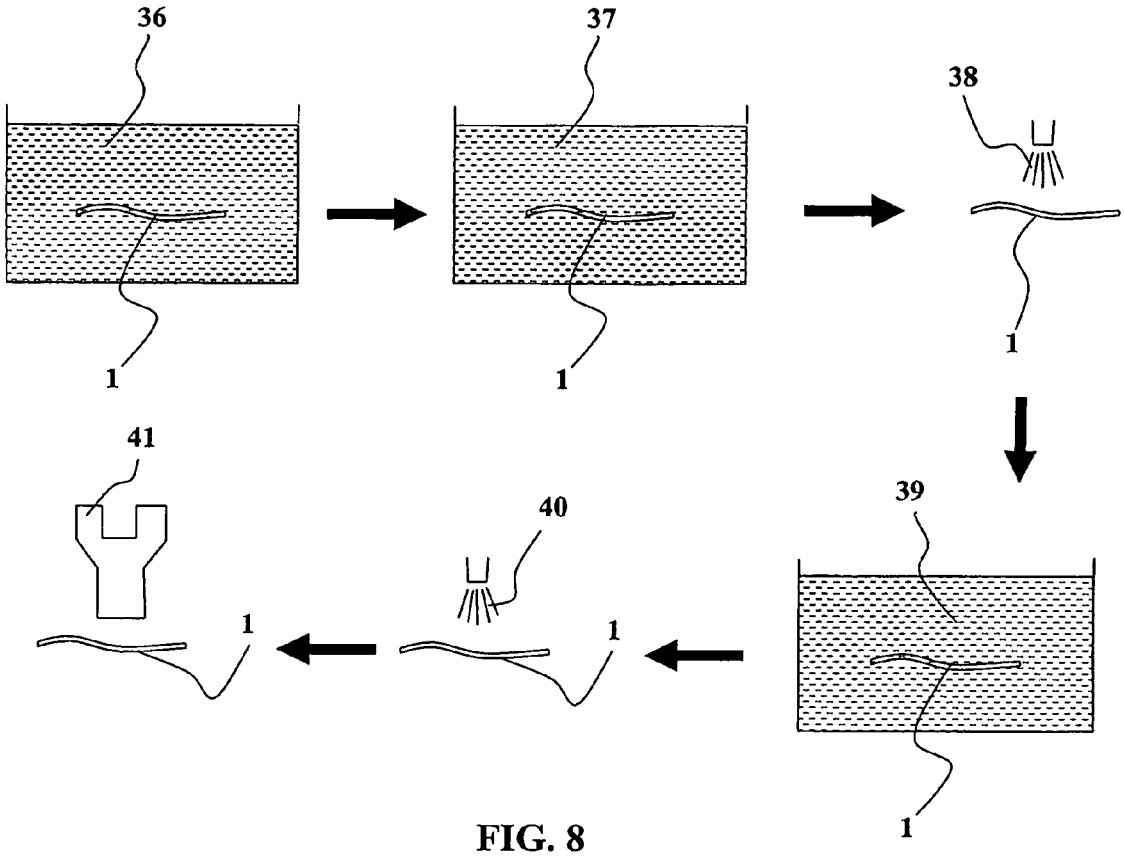
FIG. 8 shows two steps of a test process for verifying the quality of the wire obtained.

As shown in FIG. 8, a sample of wire 1 is first degreased by immersion for at least three minutes in an appropriate organic solvent 36 such as benzene, trichlorethylene or a mixture of ether and alcohol. It is then removed and dried by wiping it with a clean soft cloth. The sample of wire 1 must be held in the cloth pending continuation of the test and should not be touched with the hand.

A concentrated polysulfide solution is prepared by dissolving crystals of sodium sulfide in demineralized water at about 21° C. until saturation results and adding sufficient flowers of sulfur to obtain complete saturation, which may be verified by the presence of excess sulfur when the solution has been allowed to stand for at least 24 hours. The test solution is produced by diluting a portion of the concentrated solution with demineralized water to a specific gravity of 1.142 at 15.6° C. The sodium polysulfide test solution must have sufficient force to blacken a section of copper wire completely in 5 seconds. The test solution is not considered spent if it can still blacken a piece of copper.

A hydrochloric acid solution is prepared at the same time by diluting commercial hydrochloric acid with distilled water to a specific gravity of 1.088 as measured at 15.6° C. A portion of the hydrochloric acid solution having a volume of 180 milliliters will be considered spent if it cannot eliminate in 45 seconds the discoloration of silver caused by immersion in the polysulfide.

To test the wire, the sample of wire 1 is immersed to a length of at least 114 mm for 30 seconds in a polysulfide bath 37 containing the sodium polysulfide solution described above maintained at a temperature from 15.6° C. to 21° C.

The sample of wire 1 is then rinsed with demineralized water 38 and dried with a soft clean tissue.

The sample of wire 1 is immediately immersed for 15 seconds in the hydrochloric acid solution 39 described above, after which it is washed completely with demineralized water 40 and dried with a clean soft cloth.

Within two hours of the above treatment, the sample of wire 1 is examined, for example with the assistance of a binocular magnifier 41 at ×10 magnification. Areas at the ends of the sample of wire 1, that is to say areas less than 12.7 mm from each end thereof, are ignored.

Figure 9:
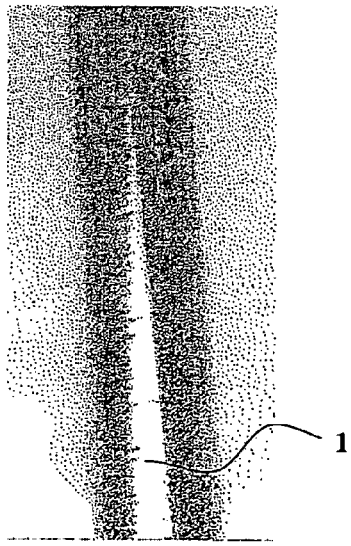
FIG. 9 shows a wire of good quality that has undergone the test.

A sample of wire 1 taken from wire of good quality, shown in the FIG. 9 photograph, shows no visible trace of the underlying copper layer being attacked by the polysulfide bath. A trace of attack is deemed to be visible if it has an area of at least 0.02 mm$^2$ at ×10 magnification (corresponding to a mark of 0.01 mm on a side at ×1 magnification).

Figure 10:
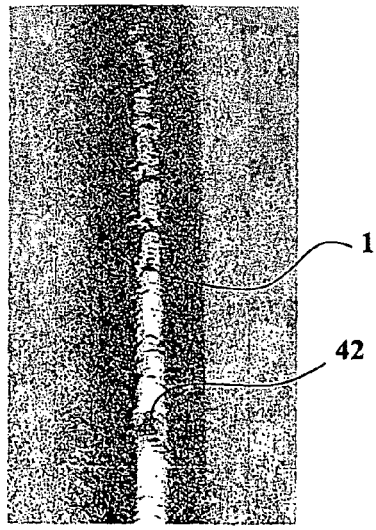
FIG. 10 shows a wire of poor quality that has undergone the test.

By contrast, a sample of wire taken from a defective wire, shown in the FIG. 10 photograph, has dark areas 42 that prove that the surface nickel layer has provided a defective seal, allowing the underlying copper to be attacked by the polysulfide bath. The wires of the samples listed in the table above were examined by this method.

The electrical conductors of the present invention could advantageously be used in all types of application requiring a good compromise between conductivity, yield point, flexibility, weight and long-term protection, in particular in aeronautics, in the automotive industry, and generally in all types of mobiles.

The present invention is not limited to the embodiments that have been explicitly described but encompasses variants and generalizations thereof within the scope of the following claims.

The invention claimed is:

1. Aluminum cable type electrical conductor comprising at least one stranded conductor based on conductive wires with an aluminum core coated with an intermediate layer of copper itself coated by a surface layer of nickel, wherein:

the surface layer of nickel has a thickness from about 1.3 μm to about 3 μm, and the surface layer of nickel has sufficient continuity to resist a polysulfide bath continuity test for at least 30 seconds without visible traces of attack of the copper appearing at ×10 magnification.

2. Conductor according to claim 1, wherein the thickness of the surface layer of nickel is from about 2 μm to about 3 μm.

3. Conductor according to claim 2, wherein the thickness of the surface layer of nickel is about 2.3 μm.

4. Conductor according to claim 1, consisting of a cable comprising seven stranded conductors each of 10 or 15 wires having an individual diameter of about 0.51 mm.

5. Conductor according to claim 1, consisting of a cable with seven stranded conductors each of 19 wires having an individual diameter of about 0.275 mm.

6. Conductor according to claim 1, consisting of a cable with stranded conductor of 61 wires having a diameter of about 0.32 mm.

7. Conductor according to claim 1, consisting of a cable with one stranded conductor of 37 wires having a diameter of about 0.32 mm or about 0.25 mm.

8. Conductor according to claim 1, consisting of a cable comprising one stranded conductor of 19 wires of about 0.30 mm or about 0.25 mm or about 0.20 mm.

9. Conductor according to claim 1, comprising a central wire of nickel-plated copper alloy surrounded by six wires of nickel-plated copper-plated aluminum with a diameter of about 0.25 mm or about 0.20 mm.

10. Conductor according to claim 1, wherein the cable is stranded with one or more true concentric or unilay concentric wires or stranded conductors.

11. Conductor according to claim 1, wherein the stranded conductor(s) and/or the cable are coated with an insulative layer of polyimide and an external layer of polytetrafluoroethylene.

12. Method for producing a conductor using a copper-plated and nickel-plated aluminum wire fabrication procedure including the following steps:

a) providing a wire blank with an aluminum core coated with a layer of copper representing 10% to 20% by volume, of diameter from twice to five times the required final diameter of the wire, b) degreasing the wire blank, c) etching the wire blank using sulfamic acid, d) depositing on the wire blank a layer of nickel by electrolysis in an electrolysis bath containing aqueous nickel sulfamate, e) rinsing the wire obtained with demineralized water, f) drawing the wire obtained in whole oil to the final diameter, g) stranding a plurality of the wires obtained in this way into bundles of wires, h) annealing in a neutral gas.

13. Method according to claim 12, wherein, in the neutral gas annealing step h), the neutral gas is nitrogen.

14. Method according claim 12, wherein, in the neutral gas annealing step h), the temperature is maintained at about 250° C. for at least about two hours.

15. Method according to claim 12, wherein, in the step d), the temperature of the electrolysis bath is maintained from about 55° C. to about 65° C., the pH of the electrolysis bath is maintained from about 2.3 to about 3.0, the current density is from 10 A/dm$^2$ to 16 A/dm$^2$, the concentration of nickel is maintained at less than 140 grams per liter approximately in the electrolysis bath.

16. Method according to claim 12, wherein, in the step d), the temperature of the electrolysis bath is about 60° C., the pH of the electrolysis bath is about 2.4, and the current density is about 15 A/dm$^2$ to about 16 A/dm$^2$.

17. Method according to claim 12, comprising a prior step $a_o$) of calibrating the copper-plated aluminum wire blank in terms of dimensions and hardness.

18. Method according to claim 12, wherein, after a calibration step $a_o$), when effected, the copper-plated aluminum wire blank has a yield point less than or equal to about 20 daN/mm$^2$ and an elongation from about 2% to about 3%.

19. Method according to claim 12, wherein, in the step c), the sulfamic acid bath has a concentration of about 40 grams per liter.

20. Method according to claim 12, wherein the initial diameter of the wire blank of copper-plated aluminum is from about 1.2 mm to about 0.8 mm, the nickel is deposited to a thickness from about 10 μm to about 15 μm, and the final diameter of the copper-plated and nickel-plated aluminum wire is from about 0.51 mm to about 0.20 mm.

21. Method according to claim 12, wherein the step b) of degreasing the wire comprises:

b1) degreasing the wire blank by ultrasound, b2) anodically degreasing the wire blank in a bath containing soda and surfactants, b3) rinsing the wire blank with demineralized water.

22. Method according to claim 12, wherein, for wires of diameter less than or equal to 0.25 mm, the stranding step g) is carried out before the annealing step h), whereas for wires of greater diameter the annealing step h) is carried out before the stranding step g).

* * * * *